US012104133B2

(12) United States Patent
Bartley et al.

(10) Patent No.: US 12,104,133 B2
(45) Date of Patent: Oct. 1, 2024

(54) FUEL ADDITIVES AND FORMULATIONS FOR IMPROVING PERFORMANCE OF GASOLINE DIRECT INJECTION ENGINES

(71) Applicant: The Lubrizol Corporation, Wickliffe, OH (US)

(72) Inventors: Stuart L. Bartley, Wickliffe, OH (US); Garrett Parker, Wickliffe, OH (US); Paul R. Stevenson, Belper (GB); Jeremy Cleron, Wickliffe, OH (US); Hannah Greenfield, Derby (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 18/269,139

(22) PCT Filed: Dec. 22, 2021

(86) PCT No.: PCT/US2021/064843
§ 371 (c)(1),
(2) Date: Jun. 22, 2023

(87) PCT Pub. No.: WO2022/140533
PCT Pub. Date: Jun. 30, 2022

(65) Prior Publication Data

US 2024/0141244 A1 May 2, 2024

Related U.S. Application Data

(60) Provisional application No. 63/130,097, filed on Dec. 23, 2020.

(51) Int. Cl.
*C10L 10/04* (2006.01)
*C10L 1/14* (2006.01)
(Continued)

(52) U.S. Cl.
CPC ..... *C10L 1/2387* (2013.01); *C10L 1/143* (2013.01); *C10L 1/1888* (2013.01);
(Continued)

(58) Field of Classification Search
CPC ..... C10L 1/2387; C10L 1/143; C10L 1/1888; C10L 1/1985; C10L 1/2222; C10L 1/224;
(Continued)

(56) References Cited

U.S. PATENT DOCUMENTS

2014/0157657 A1* 6/2014 Reid ..... C10L 1/238 123/1 A
2014/0238328 A1* 8/2014 Fang ..... C10L 10/18 44/422

FOREIGN PATENT DOCUMENTS

AU 2014226293 A1 * 9/2015 ..... C09K 15/06
EP 1518918 6/2005
(Continued)

*Primary Examiner* — Ellen M McAvoy
*Assistant Examiner* — Chantel Graham
(74) *Attorney, Agent, or Firm* — Iken S. Sans; Michael A. Miller

(57) ABSTRACT

Fuel additive compositions having at least one acylated detergent, at least one Mannich detergent, and at least one polyether and/or polyetheramine. The acylated detergent may be the reaction product of a hydrocarbyl-substituted acylating agent and a nitrogen containing compound having at least one amino group, that may optionally be quaternizable, and at least one oxygen or nitrogen atom capable of reacting with the hydrocarbyl-substituted acylating agent. The compositions are useful for reducing the formation of carbonaceous deposits and/or cleaning carbonaceous deposits in an engine, such as a gasoline direct injection engine.

10 Claims, 7 Drawing Sheets

(51) Int. Cl.

| | |
|---|---|
| ***C10L 1/188*** | (2006.01) |
| ***C10L 1/198*** | (2006.01) |
| ***C10L 1/222*** | (2006.01) |
| ***C10L 1/224*** | (2006.01) |
| ***C10L 1/2387*** | (2006.01) |
| ***C10L 10/06*** | (2006.01) |

(52) U.S. Cl.
CPC ..... *C10L 1/1985* (2013.01); *C10L 1/2222* (2013.01); *C10L 1/224* (2013.01); *C10L 10/04* (2013.01); *C10L 10/06* (2013.01); *C10L 2200/0423* (2013.01); *C10L 2270/023* (2013.01)

(58) Field of Classification Search
CPC .. C10L 10/04; C10L 10/06; C10L 2200/0423; C10L 2270/023
See application file for complete search history.

(56) References Cited

FOREIGN PATENT DOCUMENTS

| | | |
|---|---|---|
| EP | 2796534 | 10/2014 |
| GB | 2493377 | 2/2013 |
| WO | 2008/027881 | 3/2008 |
| WO | 2011/141731 | 11/2011 |
| WO | 2015/183908 | 12/2015 |
| WO | 2017/096175 | 6/2017 |

* cited by examiner

FUEL ADDITIVES AND FORMULATIONS FOR IMPROVING PERFORMANCE OF GASOLINE DIRECT INJECTION ENGINES

CROSS REFERENCE TO RELATED APPLICATION

This application claims priority from PCT Application Serial No. PCT/US2021/064843 filed on Dec. 22, 2021, which claims the benefit of U.S. Provisional Application No. 63/130,097 filed on Dec. 23, 2020.

FIELD OF THE INVENTION

The field of the disclosed technology is generally related to fuel additive compositions having at least one acylated detergent, at least one Mannich detergent, and at least one polyether and/or polyetheramine.

BACKGROUND OF THE INVENTION

In gasoline direct injection ("GDI") engines, a highly-atomized mist of fuel is injected directly into the combustion chamber of each engine cylinder under high pressures, typically between 450 and 3,000 psi. By injecting the fuel directly into the combustion chamber, GDI engines have increased fuel efficiency and higher power output compared to conventional port fuel injection gasoline ("PFI") engines wherein the fuel is directed into a cylinder intake port. This has led to a rapid adoption of GDI engines in the automotive industry.

The fuel injectors of GDI engines are prone to carbon build-up or "deposits" because of the injectors' proximity to the combustion chamber. These deposits can affect the spray pattern of fuel passing through the nozzle of the injector and reduce the amount of fuel entering into the combustion chamber.

Currently, most gasoline additives in the market are designed to maintain and/or improve PFI performance. These PFI additives include detergents, such as Mannich compounds and polyetheramines, which are added to gasoline fuels to help keep injectors clean ("keep-clean") or remove deposit build-up ("clean-up") in the injectors and elsewhere in the engine.

These PFI additives may not be providing enough keep-clean or clean-up performance in GDI vehicles, thus, new additives are needed to provide this performance. Moreover, tests have shown that GDI engines emit higher numbers of small particles in their emissions compared to PFI engines. New legislation has been introduced in Europe to regulate the number of particles of passenger vehicles to below $6\times10^{11}$ per km. It is expected that other regions, including the United States, may introduce similar emissions standards. In response to the European standard, automobile manufacturers are planning to install gasoline particulate filters, but filters are expensive, marginally effective for removing very small particles, could interfere with the automobile operability, and require servicing or replacing when they become clogged.

SUMMARY OF THE INVENTION

Novel fuel additive compositions have been found to be surprisingly effective at reducing deposits in both port fuel injection ("PFI") and direct injection gasoline ("GDI") engines. The compositions comprise an acylated detergent, a Mannich detergent, and a polyether and/or polyetheramine.

The acylated detergent may be the reaction product of a hydrocarbyl-substituted acylating agent and a nitrogen containing compound having at least one amino group, that may optionally be quaternizable, and at least one oxygen or nitrogen atom capable of reacting with the hydrocarbyl-substituted acylating agent.

In some embodiments, the at least one hydrocarbyl-substituent of the acylating agent may be a $C_{16}$ to $C_{100}$ hydrocarbyl group or $C_{18}$ to $C_{50}$ hydrocarbyl group, such as, but not limited to an octadecene and/or polyisobutylene group. In some embodiments, the hydrocarbyl-substituted acylating agent may be a hydrocarbyl-substituted succinic acid and/or hydrocarbyl-substituted succinic anhydride. The acylated detergent may be present in the composition at 5 wt % to 50 wt %, or 10 wt % to 45 wt %, based on a total weight of the composition.

The Mannich detergent may be the reaction product of a polyolefin, an aldehyde, and ammonia or an amine that may optionally be quaternizable. In some embodiments, the polyolefin used to make the Mannich is polyisobutylene. The Mannich detergent may be present in the composition at 20 wt % to 80 wt %, or 30 wt % to 70 wt %, based on a total weight of the composition.

In some embodiments, the acylated detergent and/or the Mannich detergent may be quaternized. Suitable quaternizing agents may include, but are not limited to, dialkyl sulfate, alkyl halide, hydrocarbyl substituted carbonate, carboxylate, alkyl ester, hydrocarbyl epoxides, hydrocarbyl epoxides in combination with an acid, or mixtures thereof. In some embodiments, only the acylated detergent is quaternized. In yet other embodiments, both the acylated detergent and the Mannich detergent are quaternized.

Suitable polyethers (PE) and/or polyetheramines (PEA) are not overly limited and may be any polyether or polyetheramine with detergent properties. The polyether and/or polyetheramine may be present in the composition at 10 wt % to 60 wt %, or 20 wt % to 50 wt %, based on a total weight of the composition.

In some embodiments, the composition may comprise an acylated detergent that is the reaction product of a hydrocarbyl-substituted acylating agent wherein the hydrocarbyl-substituent of the acylating agent is a $C_{16}$ to $C_{100}$ or $C_{18}$ to $C_{50}$ hydrocarbyl group and a nitrogen containing compound having at least one amino group, that may optionally be quaternizable, and at least one oxygen or nitrogen atom capable of reacting with the hydrocarbyl-substituted acylating agent. In some embodiments, the acylated detergent may be quaternized with a quaternizing agent comprising at least one dialkyl sulfate, alkyl halide, hydrocarbyl substituted carbonate, carboxylate, alkyl ester, hydrocarbyl epoxides, hydrocarbyl epoxides in combination with an acid, or mixtures thereof.

Any of the compositions described above may be used in a fuel to reduce the formation of carbonaceous deposits in a gasoline engine, such as a gasoline port fuel injection engine or a gasoline direct injection engine. In some embodiments the compositions are used in a fuel to reduce deposits in a gasoline direct injection engine and/or port fuel injection engine by either preventing or removing deposits. In some embodiments, the compositions are used in a fuel to reduce deposits in a GDI engine. In yet other embodiments, the disclosed composition is used to reduce deposits in both GDI and PFI engines.

The fuel composition may comprise as fuel that is gasoline, an oxygenate, or mixtures thereof. The disclosed compositions may be present in a fuel composition at a concentration of 25 ppm to 1000 ppm, based on a total weight of the fuel composition. Methods of reducing carbonaceous deposits in a gasoline engine are also disclosed.

DETAILED DESCRIPTION OF THE INVENTION

Figure 1:
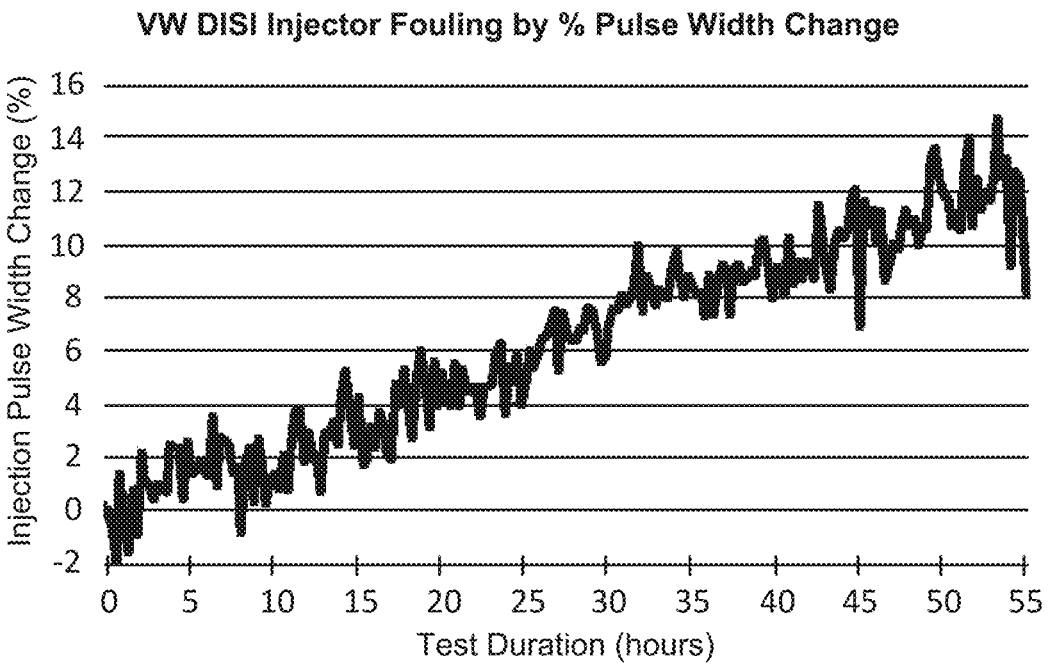
FIG. 1 is a plot showing the injector fouling of an unadditized fuel.
Figure 2:
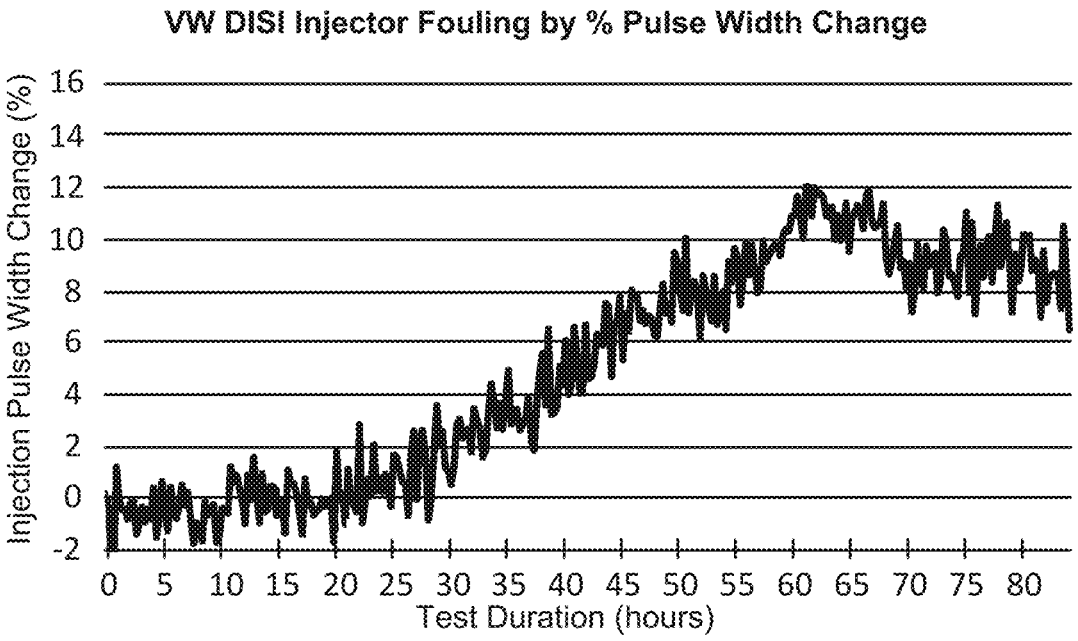
FIG. 2 is a plot showing the effectiveness of an HDSA/DMAPA Detergent in cleaning-up injector deposits.
Figure 3:
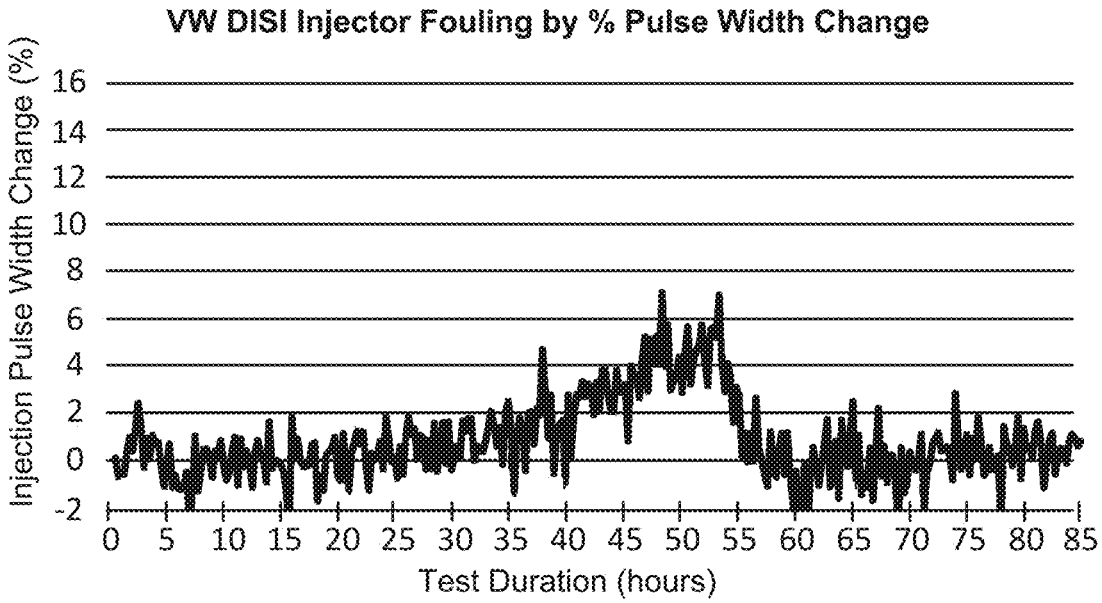
FIG. 3 is a plot showing the effectiveness of an OHA/DMAPA Detergent in cleaning-up injector deposits.
Figure 4:
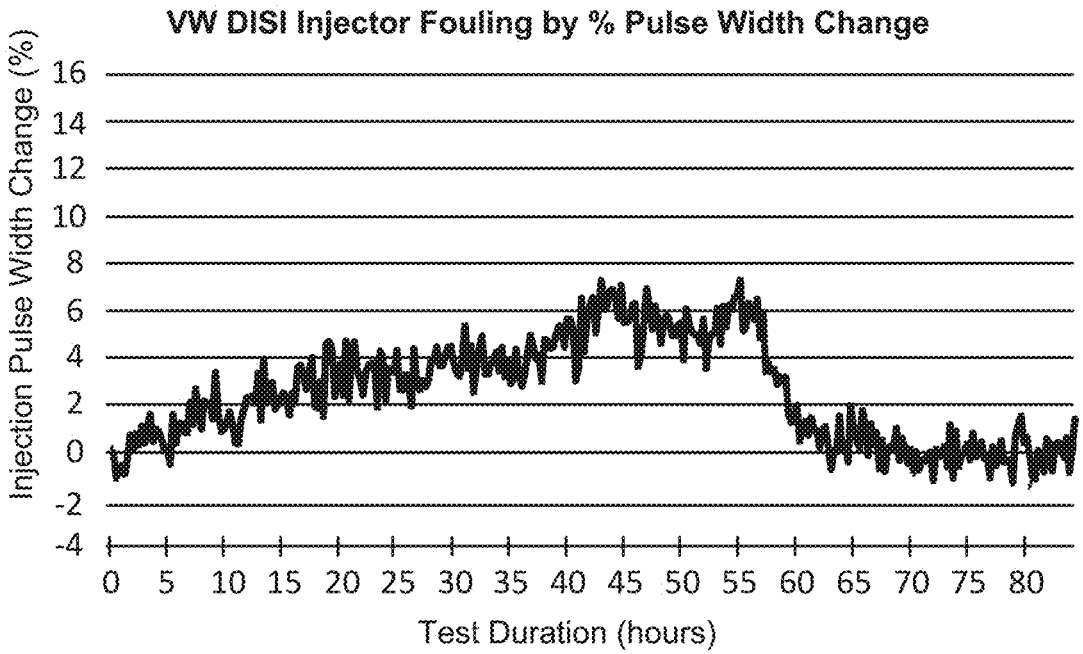
FIG. 4 is a plot showing the effectiveness of a 550 $M_n$ PIBSA/APDEA Detergent in cleaning-up injector deposits.
Figure 5:
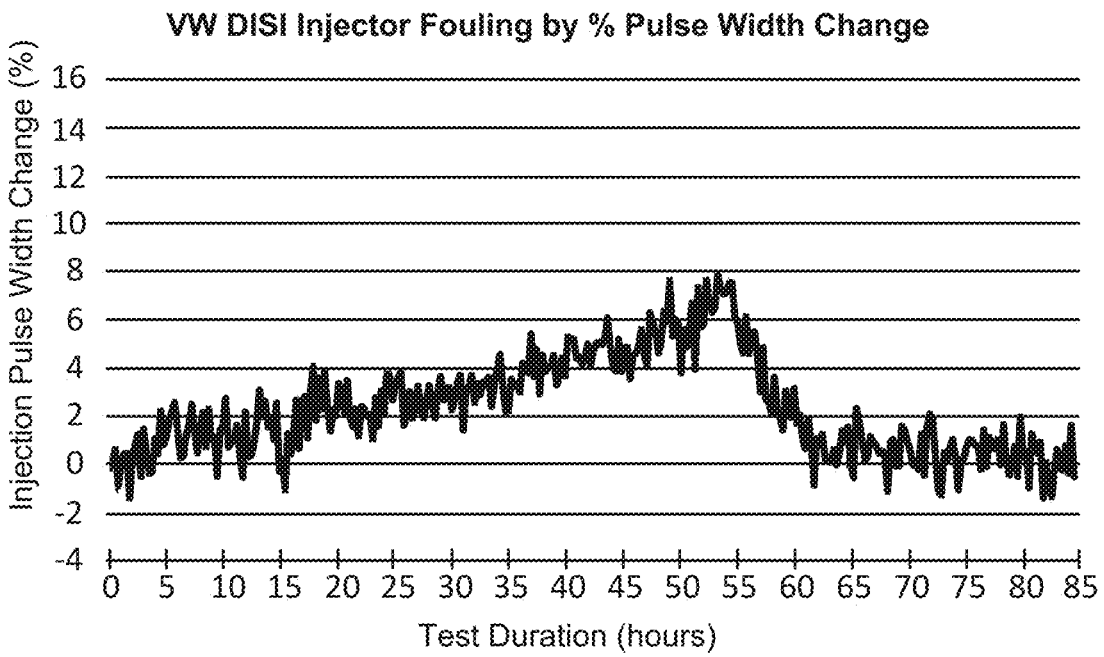
FIG. 5 is a plot showing the effectiveness of a 550 $M_n$ PIBSA/DMAPA Detergent in cleaning-up injector deposits.
Figure 6:
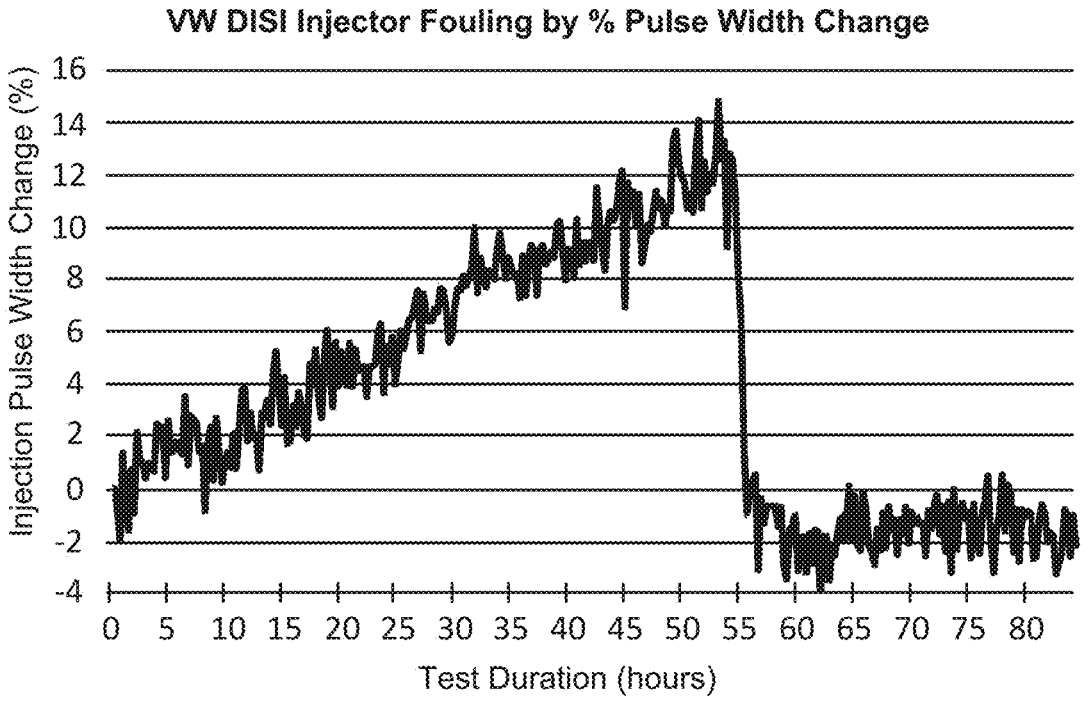
FIG. 6 is a plot showing the effectiveness a 550 $M_n$ PIBSA/DMAPA Detergent quaternized with propylene oxide in cleaning-up injector deposits.
Figure 7:
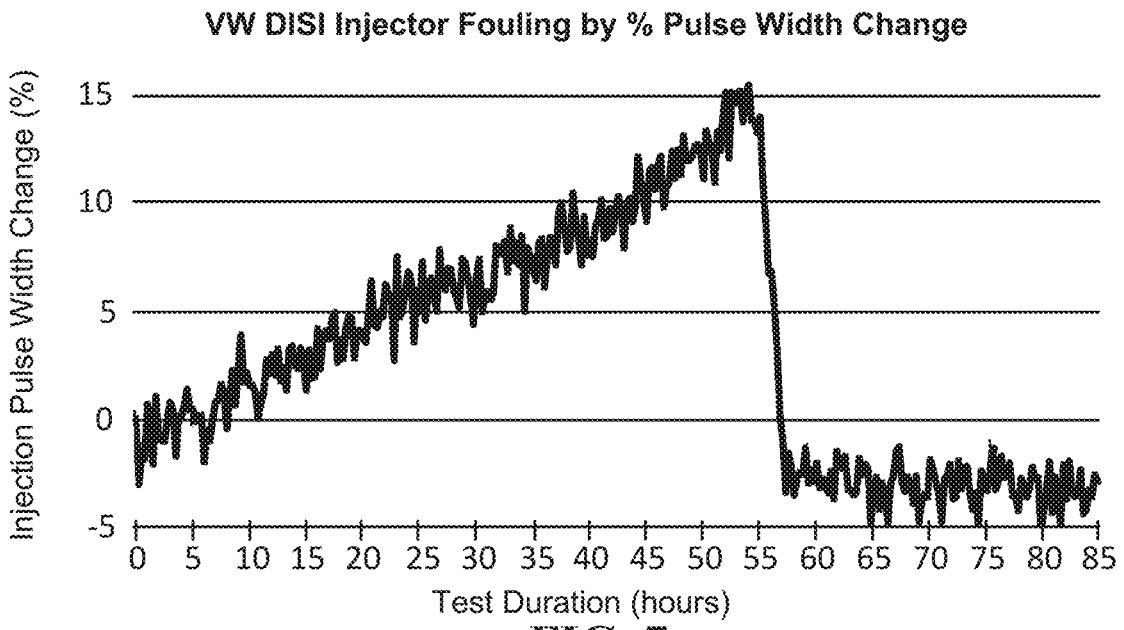
FIG. 7 is a plot showing the effectiveness a 550 $M_n$ PIBSA/DMAPA Detergent quaternized with propylene oxide in cleaning-up injector deposits when used in combination with a Mannich detergent and a polyetheramine ("Additive Package 1").
Figure 8:
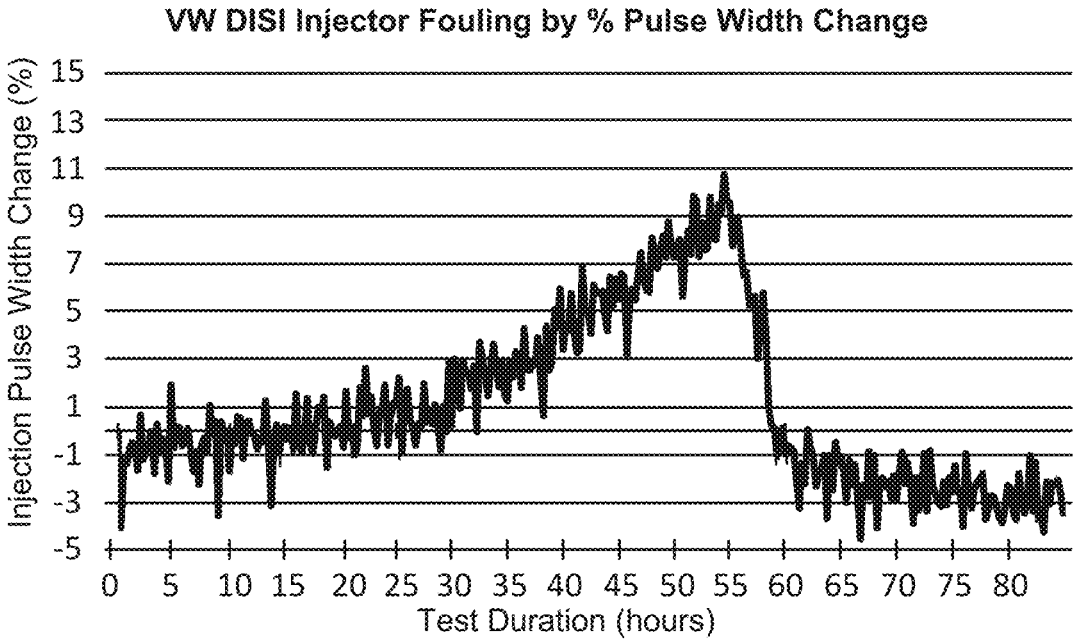
FIG. 8 is a plot showing the effectiveness of Additive Package 2.
Figure 9:
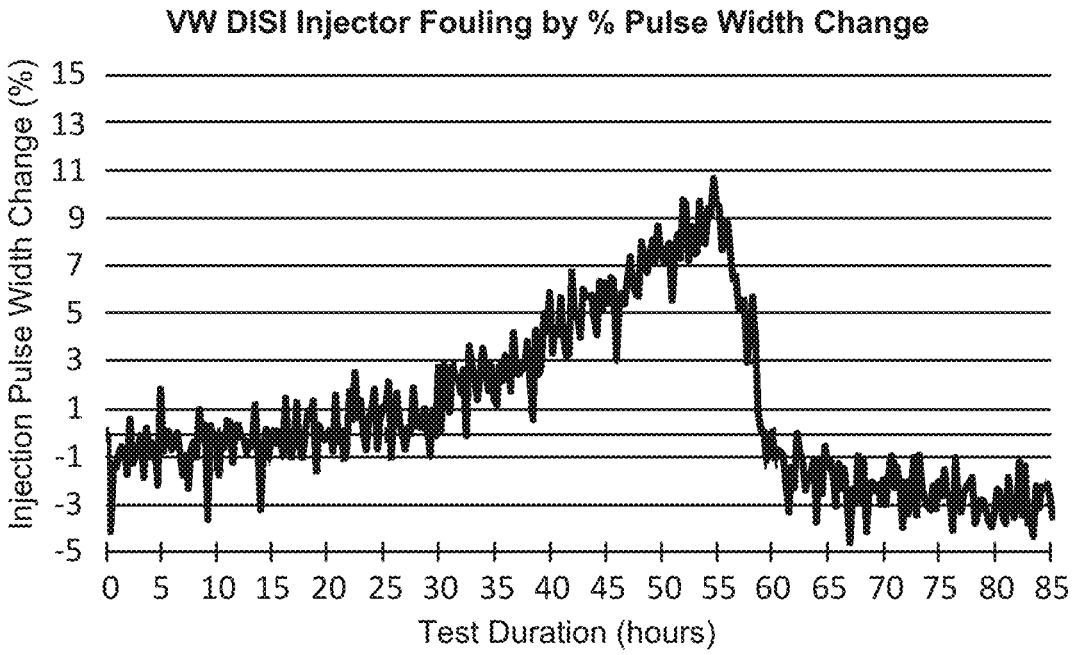
FIG. 9 is a plot showing the effectiveness of Additive Package 3.
Figure 10:
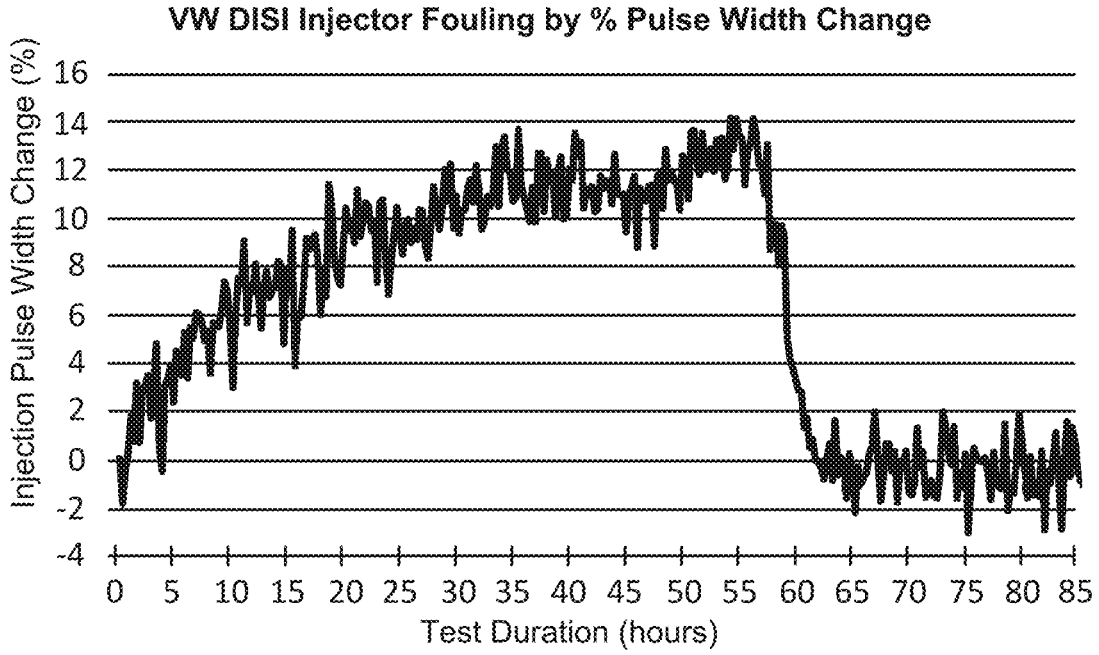
FIG. 10 is a plot showing the effectiveness of Additive Package 4.

Various preferred features and embodiments will be described below by way of non-limiting illustration.

The additive compositions disclosed herein may comprise an acylated detergent, a Mannich detergent, and a polyether and/or polyetheramine.

The acylated detergent may be the reaction product of a hydrocarbyl-substituted acylating agent and a nitrogen containing compound having at least one amino group, that may optionally be quaternizable, and at least one oxygen or nitrogen atom capable of reacting with said hydrocarbyl-substituted acylating agent.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

- hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);
- substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);
- hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

Hydrocarbyl Substituted Acylating Agent

The hydrocarbyl substituted acylating agent may be the reaction product of a long chain hydrocarbon, generally a polyolefin substituted with a monounsaturated carboxylic acid reactant such as (i) α,β-monounsaturated $C_4$ to $C_{10}$ dicarboxylic acid such as fumaric acid, itaconic acid, maleic acid.; (ii) derivatives of (i) such as anhydrides or $C_1$ to $C_5$ alcohol derived mono- or di-esters of (i); (iii) α,β-monounsaturated $C_3$ to $C_{10}$ monocarboxylic acid such as acrylic acid and methacrylic acid.; or (iv) derivatives of (iii) such as $C_1$ to $C_5$ alcohol derived esters of (iii) with any compound containing an olefinic bond represented by the general formula:

$$(R^1)(R^2)C{=}C(R^6)(CH(R^7)(R^8)) \quad \text{(I)}$$

wherein each of $R^1$ and $R^2$ is, independently, hydrogen or a hydrocarbon-based group. Each of $R^6$, $R^7$ and $R^8$ is, independently, hydrogen or a hydrocarbon-based group; preferably at least one is a hydrocarbon-based group containing at least 20 carbon atoms.

Olefin polymers for reaction with the monounsaturated carboxylic acids can include polymers comprising a major molar amount of $C_2$ to $C_{20}$, e.g. $C_2$ to $C_5$ monoolefin. Such olefins include ethylene, propylene, butylene, isobutylene, pentene, octene-1, or styrene. The polymers can be homopolymers such as polyisobutylene, as well as copolymers of two or more of such olefins such as copolymers of; ethylene and propylene; butylene and isobutylene; propylene and isobutylene. Other copolymers include those in which a minor molar amount of the copolymer monomers e.g., 1 to 10 mole % is a $C_4$ to $C_{18}$ diolefin, e.g., a copolymer of isobutylene and butadiene; or a copolymer of ethylene, propylene and 1,4-hexadiene.

In another embodiment, the olefinic bonds of formula (I) are predominantly vinylidene groups, represented by the following formulas:

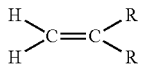

(II)

wherein R is a hydrocarbyl group

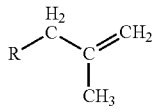

(III)

wherein R is a hydrocarbyl group.

In one embodiment, the vinylidene content of formula (I) can comprise at least about 30 mole % vinylidene groups, at least about 50 mole % vinylidene groups, or at least about 70 mole % vinylidene groups.

Accordingly, in some embodiments, the at least one hydrocarbyl-substituent of the acylating agent may be a $C_{16}$ to $C_{100}$ hydrocarbyl group or $C_{18}$ to $C_{50}$ hydrocarbyl group, such as, but not limited to an octadecene and/or polyisobutylene group.

In some embodiments, the hydrocarbyl-substituted acylating agent may be a hydrocarbyl-substituted succinic acid and/or hydrocarbyl-substituted succinic anhydride, that may optionally have a vinylidene content of at least 70 mole %. The hydrocarbyl group of the hydrocarbyl-substituted succinic acid or anhydride generally contains an average of at least about 8, or about 30, or about 35 up to about 350, or to about 200, or to about 100 carbon atoms. In one embodiment, the hydrocarbyl group is derived from a polyalkene.

Accordingly, the hydrocarbyl-substituents are generally derived from polyolefins having a number average molecular weight of from 200 to 2000, and in other instances of 250 to 1400. In one embodiment, the hydrocarbyl groups are derived from polyalkenes having a number average molecular weight ($M_n$) of about 200 to at least about 1300, or about 1500, or about 1600 up to about 5000, or to about 3000, or to about 2500, or to about 2000, or to about 1800, and the $M_w/M_n$ is from about 1.0 to about 2.0. In some embodiments the polyalkene is polyisobutylene with a number average ($M_n$) molecular weight of 200 to 1000 or 550.

As used herein, the number average molecular weight ($M_n$) is measured using gel permeation chromatography ("GPC") (Waters GPC 2000) based on polystyrene standards. The instrument is equipped with a refractive index detector and Waters Empower™ data acquisition and analysis software. The columns are polystyrene (PLgel, 5 micron, available from Agilent/Polymer Laboratories, Inc.). For the mobile phase, individual samples are dissolved in tetrahydrofuran and filtered with PTFE filters before they are injected into the GPC port.

Waters GPC 2000 Operating Conditions

Injector, Column, and Pump/Solvent compartment temperatures: 40° C.

Autosampler Control: Run time: 40 minutes

Injection volume: 300 microliter

Pump: System pressure: ~90 bars (Max. pressure limit: 270 bars, Min. pressure limit: 0 psi)

Flow rate: 1.0 ml/minute

Differential Refractometer (RI): Sensitivity: −16; Scale factor: 6

The polyalkenes include homopolymers and interpolymers of polymerizable olefin monomers of 2 to about 16 or to about 6, or to about 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the interpolymer is a homopolymer. An example of a polymer is a polybutene. In one instance about 50% of the polybutene is derived from isobutylene. The polyalkenes are prepared by conventional procedures.

Nitrogen Containing Compound

Suitable nitrogen containing compounds for making the acylated detergent have at least one amino group and at least one oxygen or nitrogen atom capable of reacting with the hydrocarbyl-substituted acylating agent. The amino group may optionally be quaternizable. Accordingly, in some embodiments, the nitrogen containing compound may have an oxygen atom and a nitrogen atom that is quaternizable. In other embodiments, the nitrogen containing compound may have at least two nitrogen atoms, one of which may be a tertiary nitrogen, i.e. the nitrogen is quaternizable.

In one embodiment, the nitrogen containing compounds having an oxygen or nitrogen atom capable of reacting with the acylating agent and further having a tertiary amino group can be represented by the following formulas:

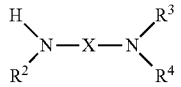

(VII)

wherein X is a alkylene group containing about 1 to about 4 carbon atoms; $R^2$ is hydrogen or a hydrocarbyl group; and $R^3$ and $R^4$ are hydrocarbyl groups.

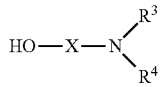

(VIII)

wherein X is a alkylene group containing about 1 to about 4 carbon atoms; $R^3$ and $R^4$ are hydrocarbyl groups.

Examples of the nitrogen or oxygen containing compounds and further having a tertiary amino group can include but are not limited to: dimethylaminopropylamine, N,N-dimethyl-aminopropylamine, N,N-diethyl-aminopropylamine, N,N-dimethyl-aminoethylamine, ethylenediamine, 1,2-propylenediamine, 1,3-propylene diamine, the isomeric butylenediamines, pentanediamines, hexanediamines, heptanediamines, diethylenetriamine, dipropylenetriamine, dibutylenetriamine, triethylenetetraamine, tetraethylenepentaamine, pentaethylenehexaamine, hexamethylenetetramine, and bis(hexamethylene) triamine, the diaminobenzenes, the diaminopyridines or mixtures thereof.

The nitrogen or oxygen containing compounds and further having a tertiary amino group can further include aminoalkyl substituted heterocyclic compounds such as 1-(3-aminopropyl)imidazole and 4-(3-aminopropyl)morpholine, 1-(2-aminoethyl)piperidine, 3,3-diamino-N-methyldipropylamine, 3'3-aminobis(N,N-dimethylpropylamine). Another type of nitrogen or oxygen containing compounds and having a tertiary amino group include alkanolamines including but not limited to triethanolamine, trimethanolamine, N,N-dimethylaminopropanol, N,N-diethylaminopropanol, N,N-diethylaminobutanol, N,N,N-tris(hydroxyethyl)amine, N,N,N-tris(hydroxymethyl)amine.

Acylated Detergent

The hydrocarbyl-substituted acylating agent and the nitrogen containing compound may be admixed under conditions suitable for them to react and form an acylated detergent. In some embodiments, when the hydrocarbyl-substituted acylating agent may be a hydrocarbyl-substituted succinic acid and/or hydrocarbyl-substituted succinic anhydride, the reaction conditions may be controlled to produce an imide or amide detergent. If the nitrogen containing compound contains an oxygen atom, an ester detergent may be formed.

Methods of making an imide, amide or ester detergent using the reaction products disclosed herein are well known in the art. In some embodiments, the acylated detergent may be prepared using nitrogen containing compound having a tertiary amino group. It should be noted, however, that even when a nitrogen containing compound used to form the acylated detergent has a tertiary amino group, the acylated detergent does not have to be quaternized for the uses disclosed herein.

The acylated detergent may be present in the composition at 5 wt % to 50 wt %, or 10 wt % to 45 wt %, based on a total weight of the composition.

Mannich Detergent

The Mannich detergent may be the reaction product of a hydrocarbyl-substituted phenol, an aldehyde, and ammonia or an amine that may optionally be quaternizable. The hydrocarbyl-substituents are generally derived from polyolefins having a number average molecular weight of from 200 to 2000, and in other instances of 250 to 1400. Polyolefins suitable for the preparing the Mannich detergent are not overly limited and include the polyolefins for the acylated detergent described above. Accordingly, in some embodiments, the hydrocarbyl-substituted phenol used to make the Mannich detergent may be substituted with a $C_{16}$ to $C_{100}$ hydrocarbyl group or $C_{18}$ to $C_{50}$ hydrocarbyl group, such as, but not limited to an octadecene and/or polyisobutylene group. In some embodiments, the hydrocarbyl-substituted phenol may be polyisobutylene, that may optionally have a vinylidene content of at least 60 mole %. In some embodiments, both the acylated detergent and the Mannich detergent are prepared with a hydrocarbyl-substituted acylating agent and/or phenol having a $C_{16}$ to $C_{100}$ or $C_{18}$ to $C_{50}$ hydrocarbyl group such as, but not limited to an octadecene and/or polyisobutylene group. In yet other embodiments, the acylated detergent and the Mannich detergent are prepared using the same hydrocarbyl-substituted succinic acid and/or hydrocarbyl-substituted succinic anhydride, for example a 550 $M_n$ polyisobutylene-substituted succinic acid.

The aldehyde used to form the Mannich detergent can be an aliphatic or aromatic aldehyde. The aldehyde can have 1 to 10 carbon atoms. The aldehyde can include for example formaldehyde, acetaldehyde, propionaldehyde, butyraldehyde, valeraldehyde, benzaldehyde, and decanal. In an embodiment, the aldehyde is formaldehyde or a reactive equivalent thereof to include trioxane, paraformaldehyde, and formalin.

The amine used to form the Mannich detergent can be a monoamine or a polyamine. In either case they will be characterized by the formula $R^4R^5NH$ wherein $R^4$ and $R^5$ are each independently hydrogen, hydrocarbon, amino-substituted hydrocarbon, hydroxy-substituted hydrocarbon, alkoxy-substituted hydrocarbon, or acylimidoyl groups. In some embodiments, no more than one of $R^4$ and $R^5$ is hydrogen. In such cases, they will be characterized by the presence within their structure of at least one H—N< group and will have at least one primary (i.e., $H_2N$—) or secondary amino (i.e., H—N<) group. Examples of monoamines include ethylamine, dimethyl amine, diethylamine, n-butylamine, dibutylamine, allylamine, isobutylamine, cocoamine, stearylamine, laurylamine, methyllaurylamine, oleylamine, N-methyl-octylamine, dodecyl-amine, diethanolamine, morpholine, and octadecylamine. The polyamine has 2 or more amino groups. The amino groups of the polyamine can be primary and/or secondary and/or tertiary provided that at least one of the amino groups is primary or secondary. The polyamine can have 2 or more carbon atoms. The polyamine can be linear and/or branched and/or cyclic, aliphatic and/or aromatic, and saturated and/or unsaturated. The polyamine can be an alkanolamine containing 1 or more hydroxyl groups. Polyamines can include for example alkylenediamines such as ethylenediamine and propylenediamine, N,N-dimethylethylenediamine, N,N'-diethylpropylene diamine, N,N-dimethyl-aminopropylamine, and N,N,N'-trimethylethylenediamine, polyethyl enepolyamines such as diethylenetriamine and polyethylene polyamine bottoms, 4-(3-aminopropyl)morpholine, and 2-(2-aminoethylamino)ethanol. In an embodiment of the invention the amine is an alkylenediamine to include for example ethylenediamine and 2-(2-aminoethylamino)ethanol.

In a further embodiment, the amine is a secondary monoamine, an alkylenediamine, or a mixture thereof. In yet other embodiments, the Mannich detergent may be the reaction product of a polyolefin, formaldehyde, and an amine, wherein the amine is a secondary monoamine, an alkylenediamine, or a mixture thereof, that may optionally be quaternizable. The Mannich detergent (unquaternized or quaternized) may be present in the composition at 20 wt % to 80 wt %, or 30 wt % to 70 wt %, based on a total weight of the composition.

Quaternized Detergents

In some embodiments, the acylated detergent and/or the Mannich detergent may be quaternized. Suitable quaternizing agents may include, but are not limited to, dialkyl sulfate, alkyl halide, hydrocarbyl substituted carbonate, carboxylate, alkyl ester, hydrocarbyl epoxides, hydrocarbyl epoxides in combination with an acid, or mixtures thereof. The respective amounts of the quaternized detergents may be the same as the unquaternized detergents described above. In some embodiments, the composition comprises a quaternized acylated detergent and an unquaternized Mannich detergent.

Suitable Polyethers and/or Polyetheramines ("Fluidizers")

The disclosed compositions comprise fluidizers such as polyethers and/or polyetheramines. These fluidizers may also have detergent properties. The polyetheramine can be represented by the formula $R[OCH_2CH(R^1)]nA$, where R is a hydrocarbyl group, $R^1$ is selected from the group consisting of hydrogen, hydrocarbyl groups of 1 to 16 carbon atoms, and mixtures thereof, n is a number from 2 to about 50, and A is selected from the group consisting of $—OCH_2CH_2CH_2NR^2R^2$ and $—NR_3R_3$, where each $R^2$ is independently hydrogen or hydrocarbyl, and each $R^3$ is independently hydrogen, hydrocarbyl or $—[R^4N(R^5)]pR^6$, where $R^4$ is $C_2$-$C_{10}$ alkylene, $R^5$ and $R^6$ are independently hydrogen or hydrocarbyl, and p is a number from 1-7. These polyetheramines can be prepared by initially condensing an alcohol or alkylphenol with an alkylene oxide, mixture of alkylene oxides or with several alkylene oxides in sequential fashion in a 1:2-50 mole ratio of hydric compound to alkylene oxide to form a polyether intermediate. U.S. Pat. No. 5,094,667 provides reaction conditions for preparing a polyether intermediate, the disclosure of which is incorporated herein by reference. In one embodiment, the alcohols can be linear or branched from 1 to 30 carbon atoms, in another embodiment 6 to 20 carbon atoms, in yet another embodiment from 10 to 16 carbon atoms. The alkyl group of the alkylphenols can be 1 to 30 carbon atoms, in another embodiment 10 to 20 carbon atoms. Examples of the alkylene oxides include ethylene oxide, propylene oxide or butylene oxide. The number of alkylene oxide units in the polyether intermediate can be 10-35 or 18-27. The polyether intermediate can be converted to a polyetheramine by amination with ammonia, an amine or a polyamine to form a polyetheramine of the type where A is $—NR^3R^3$. Published Patent Application EP310875 provides reaction conditions for the amination reaction, the disclosure of which is incorporated herein by reference. Alternately, the polyether intermediate can also be converted to a polyetheramine of the type where A is $—OCH_2CH_2CH_2NR^2R^2$ by reaction with acrylonitrile followed by hydrogenation. U.S. Pat. No. 5,094,667 provides reaction conditions for the cyanoethylation and subsequent hydrogenation, the disclosure of which is incorporated herein by reference.

In another embodiment, the fluidizer can be a polyether, which can be represented by the formula $R^7O[CH_2CH(R^8)O]qH$, where $R^7$ is a hydrocarbyl group, $R^8$ is selected from the group consisting of hydrogen, hydrocarbyl groups of 1 to 16 carbon atoms, and mixtures thereof, and q is a number from 2 to about 50. Reaction conditions for preparation as well as various embodiments of the polyethers are presented above in the polyetheramine description for the polyether intermediate. A commercial example of a polyether is the Lyondell ND™ series. Other suitable polyethers are also available from Dow Chemicals, Huntsman, and Akzo.

In yet another embodiment, the fluidizer can be a hydrocarbyl-terminated poly-(oxyalklene) aminocarbamate as described U.S. Pat. No. 5,503,644.

In yet another embodiment, the fluidizer can be an alkoxylate, wherein the alkoxylate can comprise: (i) a polyether containing two or more ester terminal groups; (ii) a polyether containing one or more ester groups and one or more terminal ether groups; or (iii) a polyether containing one or more ester groups and one or more terminal amino groups wherein a terminal group is defined as a group located within five connecting carbon or oxygen atoms from the end of the polymer. Connecting is defined as the sum of the connecting carbon and oxygen atoms in the polymer or end group.

An alkoxylate can be represented by the formula (VI):

(VI)

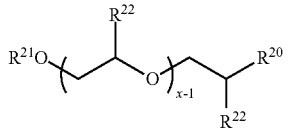

wherein, $R^{21}$ is TC(O)— wherein T is a hydrocarbyl derived from tallow fatty acid; $R^{20}$ is OH, A, WC(O)—, or mixtures thereof, wherein A is $—OCH_2CH_2CH_2NR^{23}R^{23}$ or $—NR^{24}R^{24}$, where each $R^{23}$ is independently hydrogen or hydrocarbyl, and each $R^{24}$ is independently hydrogen, hydrocarbyl or $—[R^{25}N(R^{26})]pR^{26}$ where $R^{25}$ is $C_{2-10}$-alkylene, each $R^{26}$ is independently hydrogen or hydrocarbyl, and p is a number from 1-7, W is a $C_{1-36}$ hydrocarbyl group; $R^{22}$ is H, $—CH_3$, $—CH_2CH_3$ or mixtures thereof; and X is an integer from 1 to 36.

Examples of the alkoxylate can include: $C_{12-15}$ alcohol initiated polypropyleneoxide (22-24) ether amine, Covestro AG ACTACLEAR ND21-A™ ($C_{12-15}$ alcohol initiated polypropyleneoxide (22-24) ether-ol), tall oil fatty acid initiated polypropyleneoxide (22-24) ester-ol, butanol initiated polypropyleneoxide (23-25) ether-tallow fatty acid ester, glycerol dioleate initiated polypropyleneoxide (23-25) ether-ol, propylene glycol initiated polypropyleneoxide (33-34) ether tallow fatty acid ester, tallow fatty acid initiated polypropyleneoxide (22-24) ester-ol and $C_{12-15}$ alcohol initiated polypropyleneoxide (22-24) ether tallow fatty acid ester.

These alkoxylates can be made from the reaction of a fatty acid such as tall oil fatty acids (TOFA), that is, the mixture of fatty acids predominately oleic and linoleic and contains residual rosin acids or tallow acid that is, the mixture of fatty acids are predominately stearic, palmitic and oleic with an alcohol terminated polyether such as polypropylene glycol in the presence of an acidic catalyst, usually methane sulfonic acid. These alkoxylates can also be made from the reaction of glycerol dioleate and propylene oxide in the presence of catalyst.

Suitable polyethers and/or polyetheramines are not overly limited and may be any polyether. In some embodiments the polyether may have a $C_{12}$ to $C_{15}$ hydrocarbyl group with about 24 units of propylene oxide. Similarly, the polyetheramine may have a $C_{12}$ to $C_{15}$ hydrocarbyl group with about 24 units of propylene oxide, but is terminated with a nitrogen. In one embodiment, the disclosed composition is a polyetheramine represented by the formula $R[OCH_2CH(R^1)]nA$, where R is a hydrocarbyl group, $R^1$ is selected from the group consisting of hydrogen, hydrocarbyl groups of 1 to 16 carbon atoms, and mixtures thereof, n is a number from 2 to about 50, and A is $—NR^3R^3$, where each $R^3$ is independently hydrogen, hydrocarbyl or $—[R^4N(R^5)]pR^6$, where $R^4$ is $C_2$-$C_{10}$ alkylene, $R^5$ and $R^6$ are independently hydrogen or hydrocarbyl, and p is a number from 1-7. In some embodiments, the fluidizer may be a polyether and/or polyetheramine with detergent properties. The polyether and/or polyetheramine may be present in the composition at 10 wt % to 60 wt %, or 20 wt % to 50 wt %, based on a total weight of the composition.

Any of the compositions described above may be used in a fuel composition to reduce the formation of carbonaceous deposits in a gasoline engine, such as a gasoline port fuel injection engine or a gasoline direct injection engine. The fuel may comprise gasoline, an oxygenate, or mixtures thereof. The disclosed compositions may be present in a fuel composition at a concentration of 25 ppm to 2500 ppm or 25 ppm to 1000 ppm on an actives basis, based on a total weight of the fuel composition.

Organic Solvent

In one embodiment, the fuel composition further comprises (c) an organic solvent. The organic solvent may be added to the detergents disclosed herein or be included in a fuel additive package comprising the acylated detergent, and/or the Mannich detergent, and other fuel additives. The organic solvent may provide for a homogeneous and liquid detergent composition and/or fuel additive package that facilitates handling. The organic solvent may also provide for a homogeneous fuel composition comprising gasoline and the additive composition.

In some embodiments, the organic solvent may be an aliphatic or aromatic hydrocarbon. These types of organic solvents generally boil in the range of about 65° C. to 235° C. Aliphatic hydrocarbons include various naphtha and kerosene boiling point fractions that have a majority of aliphatic components. Aromatic hydrocarbons include benzene, toluene, xylenes and various naphtha and kerosene boiling point fractions that have a majority of aromatic components. Additional organic solvents include aromatic hydrocarbons and mixtures of alcohols with aromatic hydrocarbons or kerosene having enough aromatic content that allows the additive composition to be a fluid at a temperature from about 0° C. to minus 18° C. The aliphatic or aromatic hydrocarbon may be present at about 0 to 70 wt %, 0 to 50 wt %, 0 to 40 wt %, 0 to 35 wt %, or 0 to 30 wt %, based on a total weight of the amine salt and/or additive package.

In some embodiments, the organic solvent may be an alcohol. Alcohols can be aliphatic alcohols having about 2 to 16 or 2 to 10 carbon atoms. In one embodiment, the alcohol can be ethanol, 1-propanol, isopropyl alcohol, 1-butanol, isobutyl alcohol, amyl alcohol, isoamyl alcohol, 2-methyl-1-butanol, and 2-ethylhexanol. The alcohol can be present in the additive composition at about 0 to 40 wt %, 0 to 30 wt %, or 0 to 20 wt %, based on total weight of the amine salt and/or additive package.

The solvents or combinations thereof may be selected, considering costs and treat rates to provide improved properties to the additive package, such as improved stability, lower viscosity, or higher flash points. For gasoline and/or oxygenate fuels, the organic solvent may comprise at least one of 2-ethylhexanol, naphtha, dimethylbenzene ("xylene"), or mixtures thereof. Naphtha can include heavy aromatic naphtha ("HAN"). Accordingly, in one embodiment, the organic solvent may comprise at least one of 2-ethylhexanol, naphtha, dimethylbenzene, or mixtures thereof.

Fuel

The fuel composition comprises a fuel which is liquid at room temperature and is useful in fueling an engine. The fuel is normally a liquid at ambient conditions e.g., room temperature (20 to 30° C.). The fuel can be a hydrocarbon fuel, a non-hydrocarbon fuel, or a mixture thereof. The hydrocarbon fuel can be a hydrocarbon prepared by a gas to liquid process to include for example hydrocarbons prepared by a process such as the Fischer-Tropsch process. The hydrocarbon fuel can be a petroleum distillate to include a gasoline as defined by ASTM specification D4814. In one embodiment the fuel is a gasoline, and in other embodiments the fuel is a leaded gasoline or a nonleaded gasoline. The nonhydrocarbon fuel can be an oxygen containing composition, often referred to as an oxygenate, to include an alcohol, an ether, a ketone, an ester of a carboxylic acid, a nitroalkane, or a mixture thereof. The nonhydrocarbon fuel can include, for example, methanol, ethanol, butanol, methyl t-butyl ether, methyl ethyl ketone. In several embodiments, the fuel can have an oxygenate content on a volume basis that is 1 percent by volume, or 10 percent by volume, or 50 percent by volume, or up to 85 percent by volume. In yet other embodiments, the fuel can have an oxygenate content of essentially 100 percent by volume (minus any impurities or contaminates, such as water). Mixtures of hydrocarbon and nonhydrocarbon fuels can include, for example, gasoline and methanol and/or ethanol. The ethanol may be a fuel-grade ethanol according to ASTM D4806. In various embodiments, the liquid fuel can be an emulsion of water in a hydrocarbon fuel, a nonhydrocarbon fuel, or a mixture thereof.

The fuel may comprise gasoline, oxygenate, or mixtures thereof. In one embodiment, the fuel may comprise 0.1 vol % to 100 vol % oxygenate, based on a total volume of the fuel. In yet another embodiment, the fuel may comprise 0.1 vol % to 100 vol % gasoline, based on a total volume of the fuel. In yet another embodiment, the oxygenate may be ethanol. In other embodiments, the fuel may comprise gasoline and 5 vol % to 30 vol % oxygenate, which may optionally be ethanol.

Additional Performance Additives

The fuel compositions described above can further comprise one or more additional performance additives. These additional performance additives can be based on several factors such as the type of internal combustion engine and the type of fuel being used in that engine, the quality of the fuel, and the service conditions under which the engine is being operated. The additional performance additives can include an antioxidant such as a hindered phenol or derivative thereof and/or a diarylamine or derivative thereof, a corrosion inhibitor such as an alkenylsuccinic acid, including PIB succinic acid. Some corrosion inhibitors may neutralize acid compounds in the fuel to reduce corrosion. Other corrosion inhibitors may reduce corrosion by forming a protective film on the metal surface. Corrosion inhibitors are generally effective at reducing corrosion when they are added to fuels in amounts ranging from 1 to 10 ppm, or 2 to 3 ppm by weight of the total fuel composition.

Further additives can include, dyes, bacteriostatic agents and biocides, gum inhibitors, marking agents, and demulsifiers, such as polyalkoxylated alcohols. Other additives can include lubricity agents, such as fatty carboxylic acids, metal deactivators such as aromatic triazoles or derivatives thereof, and valve seat recession additives such as alkali metal sulfosuccinate salts. Additional additives can include, antistatic agents, de-icers, and combustion improvers such as an octane or cetane improver.

In some embodiments, the additive compositions may further comprise a friction modifier or anti-wear agent. The friction modifier may provide the fuel with enhanced lubricity characteristics to reduce wear in the engine or even improve efficiency. The friction modifier can help reduce wear in the engine where the fuel is injected. In a GDI engine, friction modifiers may reduce wear at the top of the engine cylinder where the fuel is injected. Some of the friction modifier may also accumulate in the engine oil and enhance the wear characteristics of the oil as well. The friction modifier may also provide better fuel economy, by reducing friction in the engine. Accordingly, in some embodiments the additive composition may comprise 5 wt % to 25 wt % or 5 wt % to 15 wt % of a friction modifier. Suitable friction modifiers include, but are not limited to, glycerol monooleate, ethoxylated tallow amine, tall oil fatty acid, or an amine salt of a succinic ester acid or succinimide, for example an amine salt of an alkylamine or alkanolamine with a hydrocarbyl-substituted succinic anhydride. In one embodiment, the friction modifier is tall oil fatty acid. In yet another embodiment, the friction modifier is an amine salt that is the product of N,N-methyldiethanolamine and/or N1-(3-(dimethylamino)propyl)-N3,N3-dimethylpropane-1,3-diamine reacted with hexadecenylsuccinic anhydride.

The disclosed compositions may be added to a fuel as part of an additive concentrate, or additive package. Exemplary additive packages, wt % on an actives basis and based on a total weight of the additive package, are shown in Table 1 below.

TABLE 1

| | Additive Packages (wt % actives) | | | | |
|---|---|---|---|---|---|
| Additive | A | B | C | D | E |
| Acylated Detergent | 2 to 60 | 5 to 50 | 5 to 45 | 10 to 45 | 10 to 45 |
| Mannich Detergent | 5 to 80 | 20 to 80 | 20 to 75 | 25 to 70 | 30 to 70 |
| Fluidizer (polyether/polyetheramine) | 3 to 60 | 10 to 60 | 10 to 55 | 15 to 50 | 20 to 50 |
| Friction Modifier | 0 to 50 | 0 to 25 | 0 to 25 | 0 to 25 | 0 to 25 |
| Organic Solvent(s) | 0 to 80 | 0 to 70 | 0 to 60 | 0 to 60 | 0 to 60 |

TABLE 1-continued

| Additive | Additive Packages (wt % actives) | | | | |
|---|---|---|---|---|---|
| | A | B | C | D | E |
| Demulsifier (polyalkoxylated alcohol) | 0 to 10 | 0 to 8 | 0 to 5 | 0 to 4 | 0 to 4 |
| Corrosion Inhibitor (PIB-succinic acid) | 0 to 10 | 0 to 8 | 0 to 5 | 0 to 5 | 0 to 5 |
| Total (total of the above additives)* | 100 | 100 | 100 | 100 | 100 |

*Persons of ordinary skill in the art will understand that the amount of each additive for an additive package will be selected such that the total will equal 100% even if the ranges listed in the table may not equal 100%.

INDUSTRIAL APPLICATION

The fuel additive compositions described above and fuels containing such additive compositions are useful for liquid fuel engines and/or for spark ignited engines and can include engines for hybrid vehicles and stationary engines. The type of engine is not overly limited and includes, but is not limited to, V, inline, opposed, and rotary engines. The engines may be naturally aspirated, boosted, E-boosted, supercharged, or turbocharged engines. The engine may be a carbureted or fuel injected gasoline engine. As such, the engine may have a carburetor or injectors (including piezo injectors).

In one embodiment, the engine may be a gasoline direct injection ("GDI") engine (spray or wall guided, or combinations thereof), a port fuel injection ("PFI") engine, a homogeneous charge compression ignition ("HCCI") engine, stoichiometric burn or lean burn engines, spark controlled compression ignition ("SPCCI") engine, variable compression, Miller cycle or Atkinson cycle engines, or a combination thereof, such as an engine that contains both GDI and PFI injectors in the same engine. Suitable GDI/PFI engines includes 2-stroke or 4-stroke engines fueled with gasoline, a mixed gasoline/alcohol or any of the fuel compositions described in the sections above. The additive composition can reduce wear in, and/or improve fuel economy of, an engine, such as a GDI/PFI engine. In yet other embodiments, the fuel compositions may be prepared using an on-board dosing system for either a GDI engine, a PFI engine, or a combination thereof.

In yet other embodiments any of the above engines may be equipped with a catalyst or device for treating exhaust emissions, such as reducing NOx. In other embodiments the engine may be a flexible-fuel engine able to operate on more than one fuel type, typically, gasoline and ethanol or gasoline and methanol. In yet other embodiments, any of the above engine types may be in a hybrid vehicle that also includes an electric motor.

Methods of reducing carbonaceous deposits in an engine are also disclosed. The method may comprise operating the engine using the fuel composition comprising the detergents described above in an additive package. The detergent may be present in an amount of at least 10 or 20 ppm to 200 pmm ("keep clean"), or at least 100 ppm to 500 ppm ("clean-up") based on a total weight of the fuel composition. It is generally understood that keep clean treat rates are treat rates that are sufficient to keep an engine clean of carbonaceous deposits whereas clean-up treat rates are generally higher concentrations to remove a buildup of carbonaceous deposits in an engine.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The compositions disclosed herein are useful in a fuel composition for reducing the formation of carbonaceous deposits by preventing or removing carbonaceous deposits in an engine, such as a gasoline direct injection engine, which may be better understood with reference to the following examples.

EXAMPLES

Various acylated detergents are prepared by mixing a hydrocarbyl-substituted acylating agent with a nitrogen-containing compound.

Preparative Example A—550$M_n$ PIBSA

550Mn Polyisobutylene (1125 g; 2.05 mol) is charged to a 2 litre autoclave, followed by maleic anhydride (220 g: 2.25 mol). The batch is then heated to 70° C. under agitation (400 rpm). Once at temperature, the vessel is pressure tested with nitrogen at 5 bar for 10 minutes to ensure no leaks. The vessel is then purged four times with nitrogen to ensure there is no oxygen present in the vessel. The batch is heated to 225° C. and maintained at this temperature for 9 hours. The batch, a light golden viscous liquid, is then cooled to 70° C. and decanted.

Preparatory Example 1 is prepared using hexadecenyl succinic anhydride ("HDSA") as the acylating agent and dimethylaminopropylamine ("DMAPA") as the nitrogen-containing compound to form a HDSA/DMAPA acylated detergent. Hexadecenyl succinic anhydride (650 g: 2.00 moles) is charged to a 2 L flange flask. Attached to the flange flask lid is a water condenser with Dean Stark, thermocouple, nitrogen inlet and dropping funnel with dip leg. The temperature is set to 60° C., stirring set 200 rpm and nitrogen set to 0.5 standard cubic feet per hour ("SCFH"). When the reaction reaches 60° C., the DMAPA (204.9 g: 2.00 moles) is added dropwise via a dropping funnel over 60 minutes. The reaction is then heated to 135° C. and maintained at this temperature for 7 hours. The reaction is cooled to ambient temperature then decanted to a storage vessel. Approximately 35 g of water is collected by Dean Stark trap.

Preparatory Example 2 is an acylated detergent prepared from oleic acid ("OHA") and dimethylaminopropylamine. Oleic acid (700 g: 2.48 moles) is charged to a 2 L flange flask. Attached to the flange flask lid is a water condenser with Dean Stark, thermocouple, nitrogen inlet and dropping funnel with dip leg. The temperature is set to 60° C., stirring set 500 rpm and nitrogen set to 0.5 SCFH. When the reaction reached 60° C., the DMAPA (303.3 g: 2.97 moles) is added dropwise via a dropping funnel over 20 minutes. The reaction is then heated to 140° C. and maintained at this temperature for 21 hours. The temperature is then set to 150° C. and nitrogen flow to 5 SCFH and the batch is maintained under these conditions for 3 hours, to strip out excess DMAPA. The reaction is then cooled to ambient temperature then decanted to a storage vessel. Approximately 40 g water is collected by Dean Stark trap.

Preparatory Example 3 is an acylated detergent prepared from a 550 $M_n$ polyisobutylene succinic anhydride ("PIBSA") and aminopropyldiethanolamine ("APDEA") to form a PIBSA/APDEA acylated detergent. Preparative example A (375.1 g: 0.594 moles) is charged to a 1 L flange flask. Attached to the flange flask lid is a water condenser with Dean Stark, thermocouple, nitrogen inlet and dropping funnel with dip leg. The temperature is set to 110° C., stirring set 200 rpm and nitrogen set to 0.5 SCFH. When the reaction reaches 110° C. the aminopropyl diethanolamine (96.4 g: 0.594 moles) is added dropwise via a dropping funnel over 30 minutes. The reaction is slowly heated to 145° C. over 30 minutes and held for 150 minutes. The batch is cooled to 100° C. and SO-44 (157.2 g) and stirred for a further 60 minutes. The reaction is then cooled to ambient then decanted to a storage vessel.

Preparatory Example 4 is an acylated detergent prepared from a 550 $M_n$ polyisobutylene succinic anhydride ("PIBSA") and DMAPA to form a PIBSA/DMAPA acylated detergent. Preparative example A (900 g: 1.40 moles) is charged to a 2 L flange flask. Attached to the flange flask lid is a water condenser with Dean Stark, thermocouple, nitrogen inlet and dropping funnel with dip leg. The temperature is set to 90° C., stirring set 200 rpm and nitrogen set to 0.5 SCFH. When the reaction reaches 90° C. the dimethylaminopropylamine (143.4 g: 1.40 moles) is added dropwise via a dropping funnel over 60 minutes. The reaction was slowly heated to 155° C. over 60 minutes and held for 3 hours, and approximately 25 g grams of water is collected in the Dean Stark. The reaction is then cooled to ambient temperature then decanted to a storage vessel.

Preparatory Example 5 is a PIBSA/DMAPA acylated detergent that has been quaternized with propylene oxide to form a PIBSA/DMAPA quaternary ammonium salt. Example 4 (600 g: 0.83 moles) is charged to a 1 L flange flask, followed by acetic acid (49.6 g: 0.83 moles) and 2-ethylhexanol (135 g). Attached to the flange flask lid is an acetone/dry ice condenser, thermocouple, nitrogen inlet and syringe pump and needle. The temperature is set to 70° C., stirring set 200 rpm and nitrogen set to 0.1 SCFH. When the reaction reaches 70° C., propylene oxide (86.2 g: 1.49 moles) is added subsurface via syringe pump and needle over 120 minutes. After the addition of propylene oxide is completed, the reaction is held for a further 4 hours at 70° C. The reaction is then blown with nitrogen to remove excess propylene oxide before being cooled to ambient temperature then decanted to a storage vessel.

The Preparatory Examples are then added to an unadditized fuel. For Examples 1-6, a different Preparatory Example is dosed in the fuel at 200 ppm (mass basis, m/m) active chemistry. Example 7 shows the CU performance of an additive package comprising Example 6 (75 ppm of the quaternized acylated detergent m/m actives), plus a Mannich detergent and a polyetheramine, in a ratio of quaternized acylated detergent to Mannich detergent to polyetheramine of 88.2:70.2:37.8 (ppm m/m). The Examples are summarized in Table 2 below.

Accordingly, in some embodiments, the disclosed additive composition may comprise:

a. an acylated detergent that is the reaction product of:
   i. a hydrocarbyl-substituted succinic acid and/or hydrocarbyl-substituted succinic anhydride; and
   ii. a nitrogen containing compound having at least one amino group that is quaternizable and at least one oxygen or nitrogen atom capable of reacting with said hydrocarbyl-substituted acylating agent;
b. a Mannich detergent that is the reaction product of a polyolefin, formaldehyde, and an amine; and
c. a polyetheramine wherein the acylated detergent is quaternized with a quaternizing agent comprising hydrocarbyl epoxides, hydrocarbyl epoxides in combination with an acid, or mixtures thereof.

In some embodiments, the additive composition as described above may comprise:

a. 2 wt % to 60 wt %, or 5 to 50 wt %, or 5 to 45 wt %, or 10 to 45 wt %, of a quaternized acylated detergent;
b. 5 wt % to 80 wt %, or 20 to 80 wt %, 20 to 75 wt %, 25 to 70 wt %, or 30 to 70 wt % of a Mannich detergent; and
c. 3 wt % to 60 wt %, 10 to 60 wt %, 10 to 55 wt %, or 15 to 50 wt %, or 20 to 50 wtT of a polyetheramine.

In some embodiments, the additive composition as described above may comprise:

a. 5 to 50 wt % of a quaternized acylated detergent;
b. 20 to 80 wt % of a Mannich detergent; and
c. 10 to 60 wt % of a polyetheramine.

In some embodiments, the additive composition as described above may comprise:

a. 10 to 45 wt % of a quaternized acylated detergent;
b. 30 to 70 wt % of a Mannich detergent; and
c. 20 to 50 wt % of a polyetheramine.

The additized fuels are then tested to evaluate the Preparatory Examples' clean-up performance in a (engine size) Volkswagen ("VW") GDI engine. F-113_VW DISI 01 The VW DISI test (CEC-F-113) uses a Volkswagen (VW) EA111, 1.4 litre, 125 kW, 4 cylinder, inline, gasoline direct injection spark ignition (DISI) engine equipped with duel charging. The main test operation consists of a steady state cycle of 2000 rpm and 56 Nm for Keep-Clean/Dirty-Up or Clean-Up Purpose, with continuous monitoring of the injection pulse width to maintain stoichiometric Air/Fuel ratio. Each test is started by running the engine stand for 48 hours using unadditized fuel, referred to as "Haltermann DISI TF Low Sulfur" fuel. During this period, the engine control unit adjusts the injector pulse width to ensure enough fuel is being delivered to the engine as fouling interferes with fuel flow and spray. The preferred way to view this data is to plot it as the percent (%) change in Injection Pulse Width versus Test Duration (hours). FIG. 1 shows this plot for an additized fuel. Once the 48 hours are reached using the unadditized fuel, referred to as the dirty-up (DU) phase, the fuel source is switched to additized fuel to start the clean-up (CU) phase. It is estimated that it takes about 5 to 7 hours for the CU fuel blend to reach the injectors, so the actual CU is calculated starting at about 53 to 55 hours. Injector CU is measured by the rate and amount of change in the injector pulse width. To reach 100% CU, the injector pulse width must return to at least the original starting point. The CU test phase lasts 24 hours. The test result is the percentage change in the pulse width from the start to the end of the test. The test result is the percentage change in the pulse width from the start to the end of the test. The performance of each Preparatory Example and an additive package, Example 7, are summarized in Table 2 below. All of the treat rates in Table 2 are on an actives basis.

TABLE 2

| Example | Description | Treat rate acylated detergent (ppm) | Total Treat rate | FIG. | time to 100% CU |
|---|---|---|---|---|---|
| Base Fuel | Unadditized | | | 1 | N/A |
| 1 | HDSA/DMAPA Detergent | 200 | 200 | 2 | Note 1 |
| 2 | OHA/DMAPA Detergent | 200 | 200 | 3 | 2 hrs |
| 3 | 550 $M_n$ PIBSA/APDEA Detergent | 200 | 200 | 4 | 8 hrs |
| 4 | 550 $M_n$ PIBSA/DMAPA Detergent | 200 | 200 | 5 | 7 hrs |
| 5 | PO-Quaternized 550 $M_n$ PIBSA/DMAPA Detergent | 200 | 200 | 6 | 45 min |
| 6 | Example 5 plus Mannich Detergent and PEA ("Additive Package 1") | 75[A] | 176 | 7 | 2 hrs |
| 7 | Additive Package 2 | 25[B] | 70 | 8 | 4 hrs |
| 8 | Additive Package 3 | 25[C] | 179 | 9 | 7 hrs |
| 9 | Additive Package 4 | 25[D] | 184 | 10 | 7 hrs |

Note 1:

Fouling continued to increase to a 12% change in injection pulse width at about 61 hours and dropped to approximately an 8% change in injection pulse width at about 81 hours when the test ended.

[A]Treat rate of Additive Package 1 was 176 ppm. The additive package contained 35.9 wt % Mannich detergent, 42.6 wt % quaternized acylated detergent, and 21.5 wt % polyetheramine ("PEA") on an actives basis and based on a total weight of the additive package.

[B]Treat rate of Additive Package 2 was 70 ppm. The additive package contained 30.6 wt % Mannich detergent, 35.4 wt % quaternized acylated detergent, and 34.0 wt % PEA on an actives basis and based on a total weight of the additive package.

[C]Treat rate of Additive Package 3 was 179 ppm. The additive package contained 67.4 wt % Mannich detergent, 13.9 wt % quaternized acylated detergent, and 18.7 wt % PEA on an actives basis and based on a total weight of the additive package.

[D]Treat rate of Additive Package 4 was 184 ppm. The additive package contained 41.0 wt % Mannich detergent, 13.5 wt % quaternized acylated detergent, and 45.5 wt % PEA on an actives basis and based on a total weight of the additive package.

As shown in Table 2 and in FIG. 1-10, the claimed compositions are effective as reducing injector deposits in gasoline engines. The acylated detergent type and treat rate may be selected to achieve a desired CU rate. Although all of the claimed acylating detergents reduce injector deposits, the quaternized acylated detergent appears to clean up the engine at an accelerated rate as can be seen in the steep downward slope in FIG. 6 through FIG. 10.

Example Set 2

For Example Set 2, a second set of additized fuels are evaluated in a VW GDI engine using the protocol as described above, except that the unadditized fuel is switched for the additized fuel at around 41 hours, so the additized fuel reaches the injectors at around 48 hours. This is to get the test aligned with the CEC procedure that calls for a 48 hour dirty-up (DU) phase. The performance of each additive packages tested in Example Set 2 are summarized in Table 3 below. All of the treat rates in Table 3 are on an actives basis.

Figure 11:
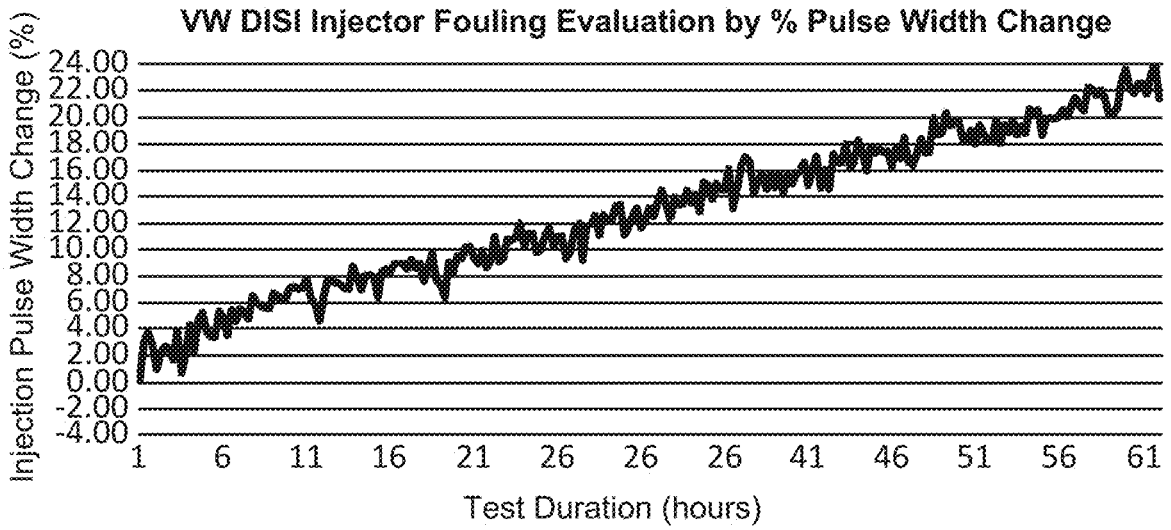
FIG. 11 is a plot showing the effectiveness of a Comparative Package.
Figure 12:
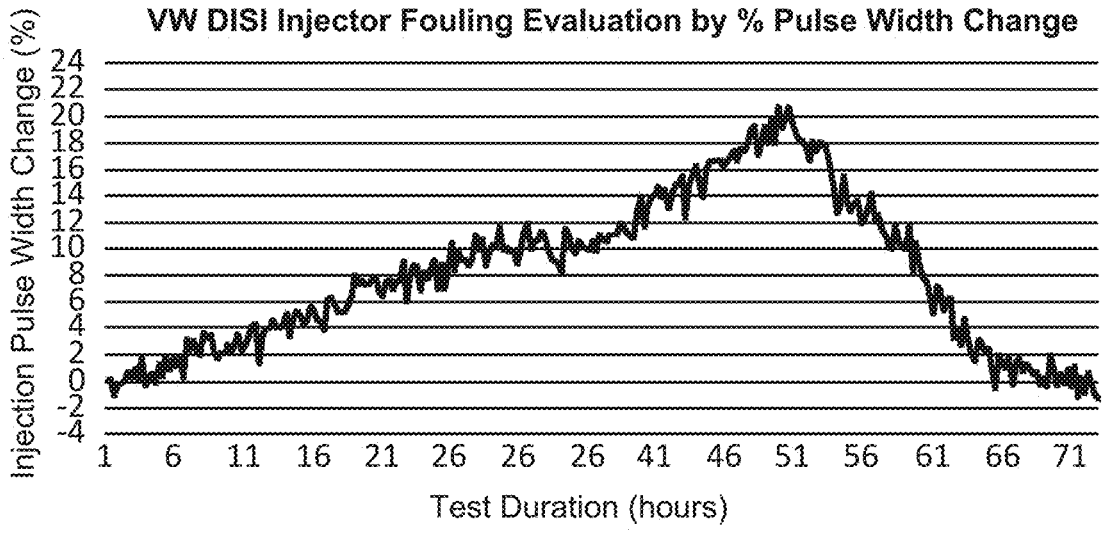
FIG. 12 is a plot showing the effectiveness of Additive Package 5.
Figure 13:
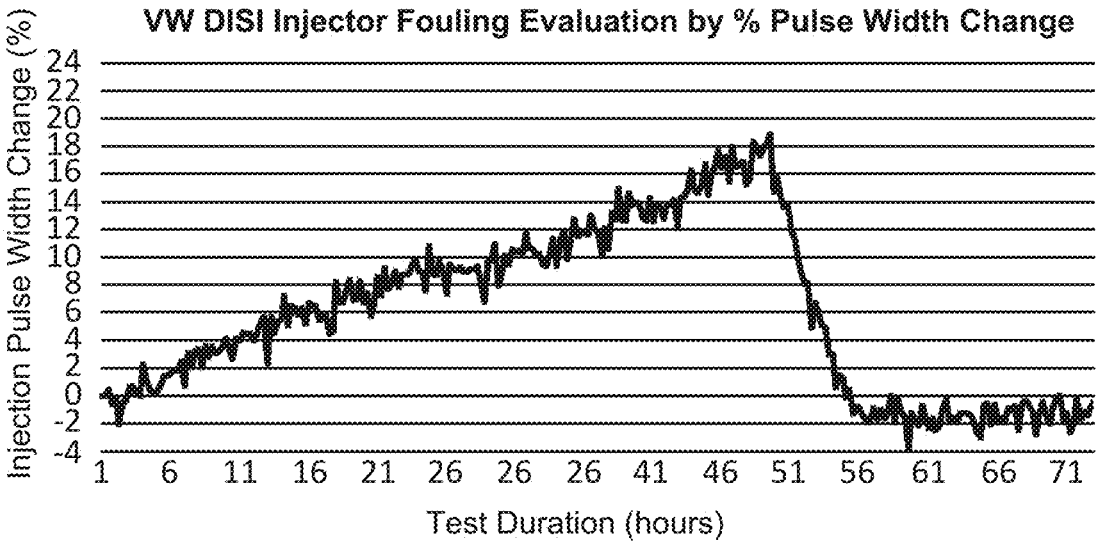
FIG. 13 is a plot showing the effectiveness of Additive Package 6.

As shown in Table 3 the Comparative Package (FIG. 11) without the acylated detergent was not effective at reducing injector deposits in gasoline engines as compared to Additive Packages 5 (FIG. 12) and 6 (FIG. 13) with a quaternized acylated detergent. Again, the acylated detergent treat rate may be selected to achieve a desired CU rate as can be seen in the increase in the downward slope in FIG. 13 with a treat rate of 16 ppm actives as compared to FIG. 12 with a treat rate of only 8 ppm actives.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be

TABLE 3

| Example | Description | Treat rate acylated detergent (ppm) | Total Treat rate | FIG. | time to 100% CU |
|---|---|---|---|---|---|
| EX2-1 | Comparative Package | 0[A] | 154.6 | 11 | N/A[1] |
| EX2-2 | Additive Package 5 | 8.1[B] | 162.7 | 12 | 17 hrs |
| EX2-3 | Additive Package 6 | 16.2[C] | 170.8 | 13 | 8 hrs |

Note 1:

No clean-up observed after 65 hours.

[A]Comparative Package did not have an acylated detergent. The total treat rate was 154.6 ppm. The additive package contained 78.3 wt % Mannich detergent and 21.7 wt % PEA on an actives basis and based on a total weight of the additive package.

[B]Treat rate of Additive Package 5 was 162.7 ppm. The additive package contained 74.3 wt % Mannich detergent, 5.0 wt % quaternized acylated detergent, and 20.7 wt % PEA on an actives basis and based on a total weight of the additive package.

[C]Treat rate of Additive Package 6 was 170.8 ppm. The additive package contained 70.8 wt % Mannich detergent, 9.5 wt % quaternized acylated detergent, and 19.7 wt % PEA on an actives basis and based on a total weight of the additive package.

understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A method of reducing carbonaceous deposits in a gasoline engine, said method comprising adding an additive composition to a fuel that is gasoline, oxygenate, or mixtures thereof and operating the gasoline engine, wherein the additive composition comprises:

a. an acylated detergent that is the reaction product of:
   i. a hydrocarbyl-substituted acylating agent wherein the hydrocarbyl-substituted acylating agent is a hydrocarbyl-substituted succinic acid and/or hydrocarbyl-substituted succinic anhydride; and
   ii. a nitrogen containing compound having at least one amino group that is quaternizable and at least one oxygen or nitrogen atom capable of reacting with said hydrocarbyl-substituted acylating agent, wherein acylated detergent is quaternized with a quaternizing agent comprising at least one dialkyl sulfate, alkyl halide, hydrocarbyl substituted carbonate, carboxylate, alkyl ester, hydrocarbyl epoxides, hydrocarbyl epoxides in combination with an acid, or mixtures thereof and wherein the acylated detergent is present in said additive composition at 5 wt % to 50 wt %, based on a total weight of said additive composition;

b. 20 wt % to 80 wt % of a Mannich detergent that is the reaction product of a polyolefin, an aldehyde, and ammonia or an amine that may optionally be quaternizable; and c. 10 wt % to 60 wt % of a polyether and/or a polyetheramine, wherein the additive composition is present at 25 ppm to 2500 ppm on an actives basis, based on a total weight of the fuel.

2. The method of claim 1, wherein the Mannich detergent is quaternized with a quaternizing agent comprising at least one dialkyl sulfate, alkyl halide, hydrocarbyl substituted carbonate, carboxylate, alkyl ester, hydrocarbyl epoxides, hydrocarbyl epoxides in combination with an acid, or mixtures thereof.

3. The method of claim 1, wherein the acylated detergent is quaternized with hydrocarbyl epoxides or hydrocarbyl epoxides in combination with an acid.

4. The method of claim 1, wherein the polyolefin used to make the Mannich detergent is polyisobutylene.

5. The method of claim 1, wherein the Mannich detergent is present in said additive composition at 30 wt % to 70 wt %, based on a total weight of said additive composition.

6. The method of claim 1, wherein the polyether and/or polyetheramine is present in said additive composition at 20 wt % to 50 wt %, based on a total weight of said additive composition.

7. The method of claim 1, further comprising a friction modifier, which is tall oil fatty acid.

8. The method of claim 1, wherein the fuel comprises 0.1 vol % to 100 vol % gasoline, based on a total volume of the fuel.

9. The method of claim 8, wherein the fuel comprises 5 vol % to 30 vol % oxygenate, based on a total volume of the fuel.

10. The method of claim 9, wherein the oxygenate is ethanol.

* * * * *